US009057233B2

(12) United States Patent
Ree et al.

(10) Patent No.: US 9,057,233 B2
(45) Date of Patent: Jun. 16, 2015

(54) BOOST SYSTEM AND METHOD FOR DUAL GRADIENT DRILLING

(71) Applicant: AGR SUBSEA AS, Straume (NO)

(72) Inventors: Sigurd Ree, Loddefjord (NO); Roger Sverre Stave, Bergen (NO)

(73) Assignee: AGR SUBSEA AS, Straume (NO)

( * ) Notice: Subject to any disclaimer, the term of this patent is extended or adjusted under 35 U.S.C. 154(b) by 0 days.

(21) Appl. No.: 14/375,550

(22) PCT Filed: Jan. 16, 2013

(86) PCT No.: PCT/NO2013/050011

§ 371 (c)(1),
(2) Date: Jul. 30, 2014

(87) PCT Pub. No.: WO2013/115651

PCT Pub. Date: Aug. 8, 2013

(65) Prior Publication Data

US 2015/0008036 A1 Jan. 8, 2015

Related U.S. Application Data

(60) Provisional application No. 61/592,774, filed on Jan. 31, 2012.

(51) Int. Cl.

| | |
|---|---|
| ***E21B 7/12*** | (2006.01) |
| ***E21B 17/01*** | (2006.01) |
| ***E21B 21/00*** | (2006.01) |
| ***E21B 21/10*** | (2006.01) |

(52) U.S. Cl.

CPC ..... *E21B 21/001* (2013.01); *E21B 7/12* (2013.01); *E21B 17/01* (2013.01); *E21B 21/10* (2013.01)

(58) Field of Classification Search

CPC ..... E21B 7/12; E21B 17/01; E21B 19/004; E21B 21/001

USPC ..... 175/5, 207, 217; 166/358, 367

See application file for complete search history.

(56) References Cited

U.S. PATENT DOCUMENTS

| | | | | |
|---|---|---|---|---|
| 4,046,191 | A * | 9/1977 | Neath | 166/352 |
| 4,210,208 | A * | 7/1980 | Shanks | 166/352 |
| 4,756,368 | A * | 7/1988 | Ikuta et al. | 166/267 |
| 4,813,495 | A * | 3/1989 | Leach | 175/6 |
| 6,068,053 | A * | 5/2000 | Shaw | 166/267 |
| 6,328,107 | B1 * | 12/2001 | Maus | 166/335 |
| 6,474,422 | B2 * | 11/2002 | Schubert et al. | 175/69 |
| 6,530,437 | B2 * | 3/2003 | Maurer et al. | 175/5 |
| 6,634,387 | B1 * | 10/2003 | Glejbol | 138/104 |
| 6,668,943 | B1 * | 12/2003 | Maus et al. | 175/5 |

(Continued)

FOREIGN PATENT DOCUMENTS

WO WO 2011/058031 A2 5/2011

*Primary Examiner* — Matthew Buck

(74) *Attorney, Agent, or Firm* — Foley & Lardner LLP

(57) ABSTRACT

Boost system and method for dual gradient drilling where a marine riser (1) has a mud return line (14) connected at a first connection position (18) below the lowest foreseeable mud level (12) in the marine riser (1), and where a mud return pump (16) is connected to the mud return line (14), and where a recirculation line (20) that has a recirculation pump (22), is connected to the marine riser (1) at a second connection position (24) below the lowest foreseeable mud level (12) in the marine riser (1), and at a third connection position (26) on the marine riser (1) below said second connection position (24).

9 Claims, 6 Drawing Sheets

(56) References Cited

U.S. PATENT DOCUMENTS

| | | | | |
|---|---|---|---|---|
| 8,322,460 | B2 * | 12/2012 | Horton et al. | 175/5 |
| 8,342,248 | B2 * | 1/2013 | Hall et al. | 166/344 |
| 8,640,778 | B2 * | 2/2014 | Fossli | 166/367 |
| 2003/0066650 | A1 * | 4/2003 | Fontana et al. | 166/358 |
| 2010/0175882 | A1 * | 7/2010 | Bailey et al. | 166/335 |
| 2011/0061872 | A1 | 3/2011 | Mix et al. | |
| 2011/0129358 | A1 | 6/2011 | Jennings | |
| 2011/0278014 | A1 * | 11/2011 | Hughes et al. | 166/367 |

* cited by examiner

BOOST SYSTEM AND METHOD FOR DUAL GRADIENT DRILLING

There is provided a boost system for dual gradient drilling. More precisely there is provided a boost system for dual gradient drilling where a marine riser has a mud return line connected at a position below the lowest foreseeable mud level in the marine riser, and where a mud return pump is connected to the mud return line. The invention also includes a method for boosting mud return flow under dual gradient drilling.

When drilling subsea wells, typically in connection with petroleum exploration, problems of keeping a desired pressure in the well and the related gas inflow are commonly encountered.

Drill fluid is pumped from a surface rig through the drill pipe to the drill bit at the bottom hole assembly. From the drill bit the drill fluid returns to the surface rig via the wellbore annulus and a riser, carrying drill cuttings with it.

As flow friction is present at drill fluid circulation, the bottom hole pressure is different at drill fluid circulation and at none circulation. The flow friction is dependent on properties such as fluid density, viscosity and content of cuttings. The flow friction is included in a commonly used term: "Equivalent circulating density" (ECD) that is closely related to the bottom hole pressure.

At the bottom of a subsea well the allowable pressure band is usually limited by a lower pressure when formation fluid will flow into the well, and an upper limit when the pressure may lead to fracture of the well formation. This pressure band is often comparatively narrow. In some cases the flow friction may cause the bottom hole pressure to exceed the allowable pressure band. If this is the case and the drill fluid density is adjusted to just keep the well stable at non-circulating situations, fracture of the well formation may occur at circulation of drill fluid.

Adjusting the density of the drill fluid may partly remedy the problem, but may among other negative effects result in insufficient transport of drill cuttings to the surface.

A technique termed "dual gradient drilling" has been successfully employed to adjust the bottom hole pressure. Dual gradient drilling relies on relatively quickly being able to adjust the head of fluid in the well. Most commonly this is achieved by adjusting the mud height level in the marine riser. The level is kept at a relatively low level in the marine riser when mud is circulating, and then raised to a higher level at none circulation as is the case for instance when sections of drill pipe are added to or removed from the drill string.

A separate mud return line having a mud return pump is connected to the marine riser at a position below the lowest foreseeable mud level. The return mud with cuttings is thus extracted from the marine riser and pumped to a drill rig through the mud return line.

Under some conditions it is not possible to have a sufficient mud flow through the drill pipe to avoid settling of cuttings in the marine riser. Marine risers are therefore often equipped with a boost line that extends from the drill rig and to the marine riser at a position close to the sea bed. Mud without cuttings, termed "clean mud" is flowed through the boost line down to the marine riser. The sum of the mud flow through the drill pipe to the bore hole and through the boost line is sufficient to avoid settling of cuttings in the marine riser.

The addition of mud to the marine riser requires that the mud return line and mud return pump are dimensioned to cope with the added mud. It is obvious that at mud return line lengths of say 500-1000 m the equipment weight increase and added running energy cost are significant.

The purpose of the invention is to overcome or reduce at least one of the disadvantages of the prior art.

The purpose is achieved according to the invention by the features as disclosed in the description below and in the following patent claims.

According to a first aspect of the invention there is provided a boost system for dual gradient drilling where a marine riser has a mud return line connected at a first connection position below the lowest foreseeable mud level in the marine riser, and where a mud return pump is connected to the mud return line, wherein a recirculation line that has a recirculation pump, is connected to the marine riser at a second connection position below the lowest foreseeable mud level in the marine riser, and at a third connection position on the marine riser that is below the second connection position.

By circulating mud through the recirculation line the necessary flow rate to avoid settling in the marine riser is achieved without increasing the flow through the mud return line. The energy used for the recirculation pump, that only has to overcome the flow friction, is only a fraction of the additional energy needed by the mud return pump when the same amount of additional mud is to be pumped up to the drill rig.

However, unlike flow through the conventional boost line as mentioned in the description of prior art, which adds clean mud only, flow through the recirculation line will not dilute the return mud from the well neither for cuttings nor entrapped gas. Potential risk of an explosive atmosphere above the mud level in the raiser may be eliminated for instance by addition of an inert gas or by keeping a relatively small downward flow of clean mud from the mud surface by adding some clean mud to the marine riser above the mud surface in the marine riser.

The lower third connection position of the recirculation line to the marine riser may be near the sea bed to avoid settling of cuttings in the marine riser near the sea bed.

The marine riser may be equipped with a boost line that is closable by use of a boost line valve, and the mud return line, downstream the mud return pump, may be connected to the boost line at a position above the boost line valve.

Thus the boost line above the boost line valve may fill the function of the mud return line.

The recirculation line may, downstream the recirculation pump, be connected to the boost line at a position below the boost line valve.

The part of the boost line below the boost line valve may thus fill the function of the recirculation line.

The marine riser may have a riser isolation devise positioned above the first connection position of the mud return line to the marine riser.

A riser isolation device in the marine riser's annulus is used for quickly enable pressure change below the riser isolation device.

A riser isolation bypass line may be connected between the marine riser at a position above the riser isolation device and at the recirculation line at a position upstream the recirculation pump.

The riser isolation bypass line may be used for the supply of clean mud from above the riser isolation device and to the marine riser at a position below the riser isolation device via the recirculation line.

The riser isolation bypass line may have a riser isolation bypass valve for closing off the riser isolation bypass line, thus enabling operation according to the basic principle of the recirculation line stated above.

A riser connection valve may be positioned in the recirculation line between the second connection position to the marine riser and the recirculation boost pump in order to close off the upper second connection position from the recirculation line to the marine riser when clean mud is to be flown from above the riser isolation device.

According to a second aspect of the invention there is provided a method for boosting return flow at dual gradient drilling where a marine riser has a mud return line connected at a first connection position below the lowest foreseeable mud level in the marine riser, and where a mud return pump is connected to the mud return line, and where the method includes:

connecting a recirculation line that has a recirculation pump, to the marine riser at a second connection position below the lowest foreseeable mud level in the marine riser, and at a third connection position on the marine riser below the second connection position, and circulating mud downwardly through the recirculation line.

The pressure may be measured by a sensor positioned near or in the first connection position. The measured pressure at this position will give input to a control system for regulating the pump capacity of the different pumps according to the present situation.

The boost system and the method for boosting mud flow according to the invention under dual gradient drilling render it possible to significantly reduce the weight of related equipment as well as the operating energy cost of the mud return pump.

Below, an example of a preferred boost system and method is explained under reference to the enclosed drawings, where:

Figure 1:
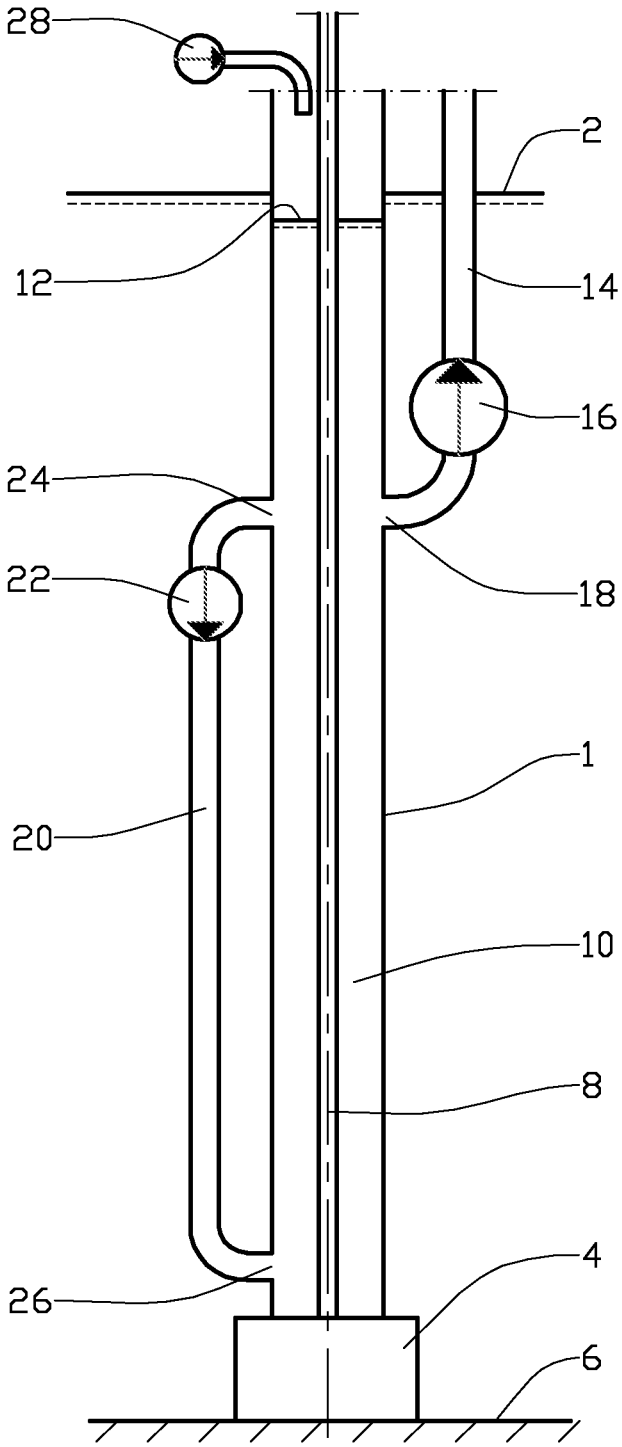
FIG. 1 shows a sketch of a boost system according to the invention.

On the drawings the reference number 1 denotes a marine riser that extends from a not shown drilling rig on the sea surface 2 and down to a blow out preventer 4 at the sea bed 6. A drill pipe 8 is positioned inside the marine riser 1. An annulus 10 is formed between the marine riser 1 and the drill pipe 8.

The annulus 10 is filled with mud up to a mud level 12. A mud return line 14 that is equipped with a mud return pump 16 is connected to the marine riser 1 at a first connection position 18 below the mud level 12, and extends up to the drilling rig not shown. The purpose of the mud return line 14 and the mud return pump 16 is to enable extraction of mud from the marine riser 1 below the mud level 12.

A recirculation line 20 having a recirculation pump 22 is connected to the marine riser 1 at a second connection position 24 below the mud level 12 and at a third connection position 26 that is below the second position 24, preferably close to the sea bed 6.

The purpose of the recirculation line 20 and the recirculation pump 22 is to increase the flow of mud through the annulus 10 to avoid settling of cuttings in the marine riser 1.

A topside mud pump 28 is arranged to supply clean mud to the marine riser 1 at the not shown drilling rig.

Figure 2:
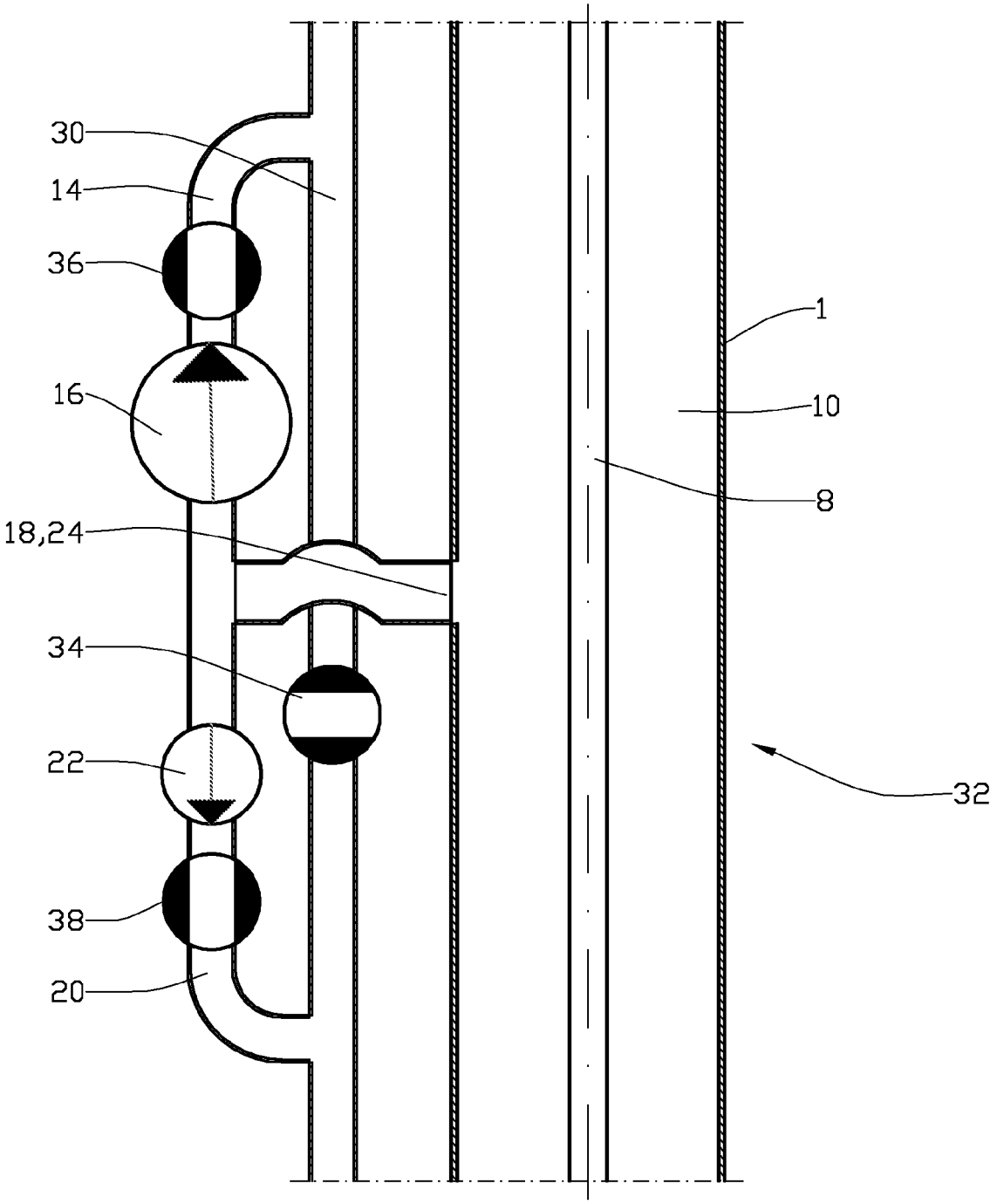
FIG. 2 shows to a grater scale a practical boost system according to FIG. 1 for a marine riser having a boost line with a boost line valve.

FIG. 2 shows a sketch of how the boost system practically may be incorporated in a marine riser 1 that is equipped with a boost line 30. The boost line 30 is parallel with the marine riser 1 along a section 32 of the marine riser 1.

A boost line valve 34 is fitted to the boost line 30. In this embodiment the first and second connection positions 18, 24 is common and leads to both the mud return pump 16 and the recirculation pump 22. The mud return line 14 that is equipped with a mud return valve 36 is downstream connected to the boost line 30 above the boost line valve 34.

A recirculation valve 38 is included in the recirculation line 20. The recirculation line 20 is downstream connected to the boost line 30 below the boost line valve 34.

In the embodiment shown in FIG. 2 the boost line valve 34 is closed while the mud return valve 36 and the recirculation valve 38 are open. The flow through the mud return line 14 passes through the upper part of the boost line 30 to the drilling rig not shown, while the flow through the recirculation line 20 passes through the lower part of the boost line 30 to the annulus 10 of the marine riser 1.

Figure 3:
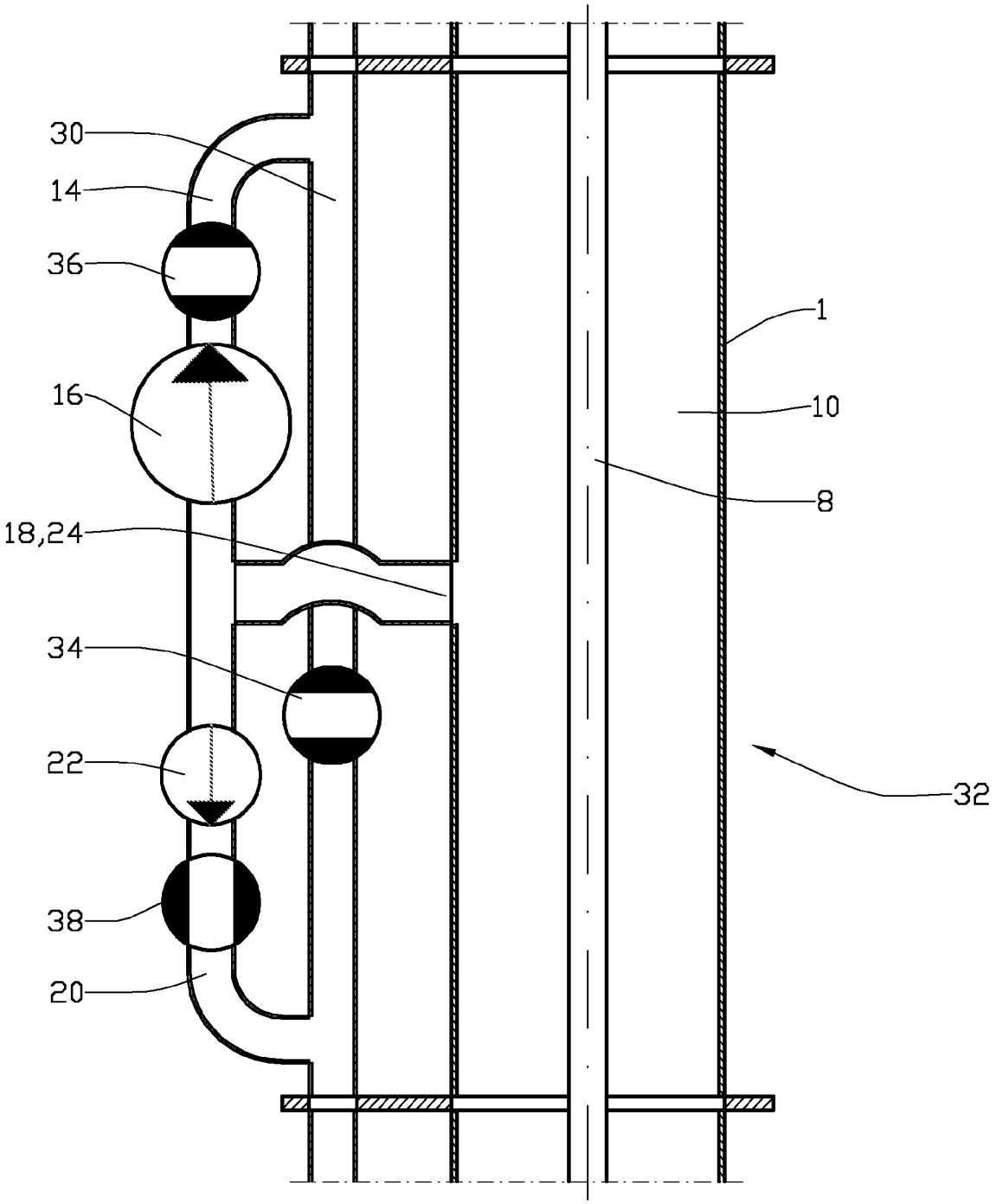
FIG. 3 shows the same as in FIG. 2, but with a mud return valve closed.

In FIG. 3 the mud return valve 36 is closed. The mud is circulated through the recirculation line 20 and the lower part of the boost line 30 into the annulus 10 to keep the mud in the annulus 10 flowing in order to prevent settling in the marine riser 1 for instance during connection work on the drill pipe 8.

Figure 4:
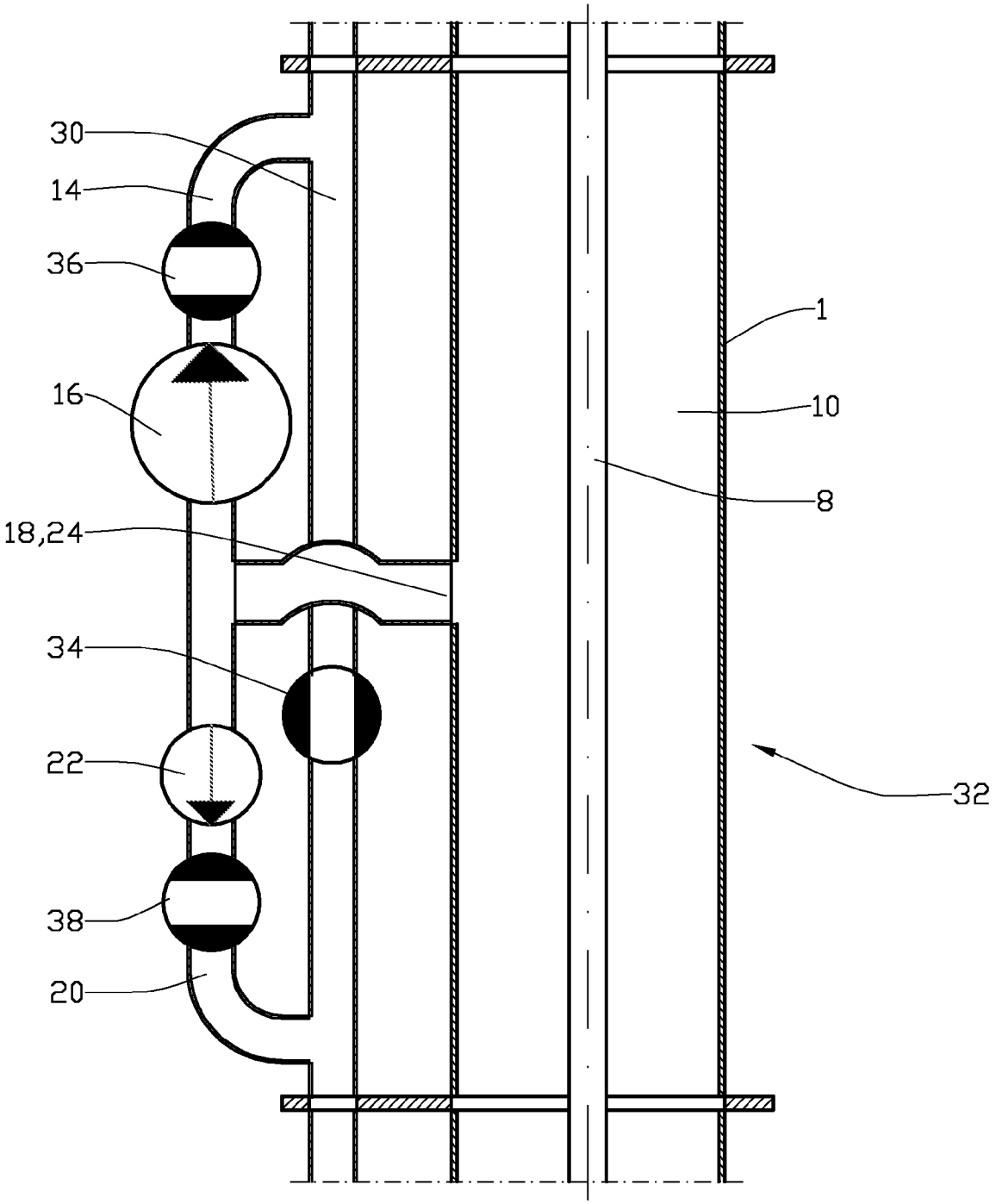
FIG. 4 shows the same as in FIG. 3, but also with a recirculation valve closed and the boost line valve open for resuming normal operation of the boost line.

In FIG. 4 the boost line valve 34 is open while the mud return valve 36 and the recirculation valve 38 are closed. The standard operation of the boost line 30 may be resumed, for instance if the boost line 30 and the annulus 10 are to be cleaned by use of clean mud.

Figure 5:
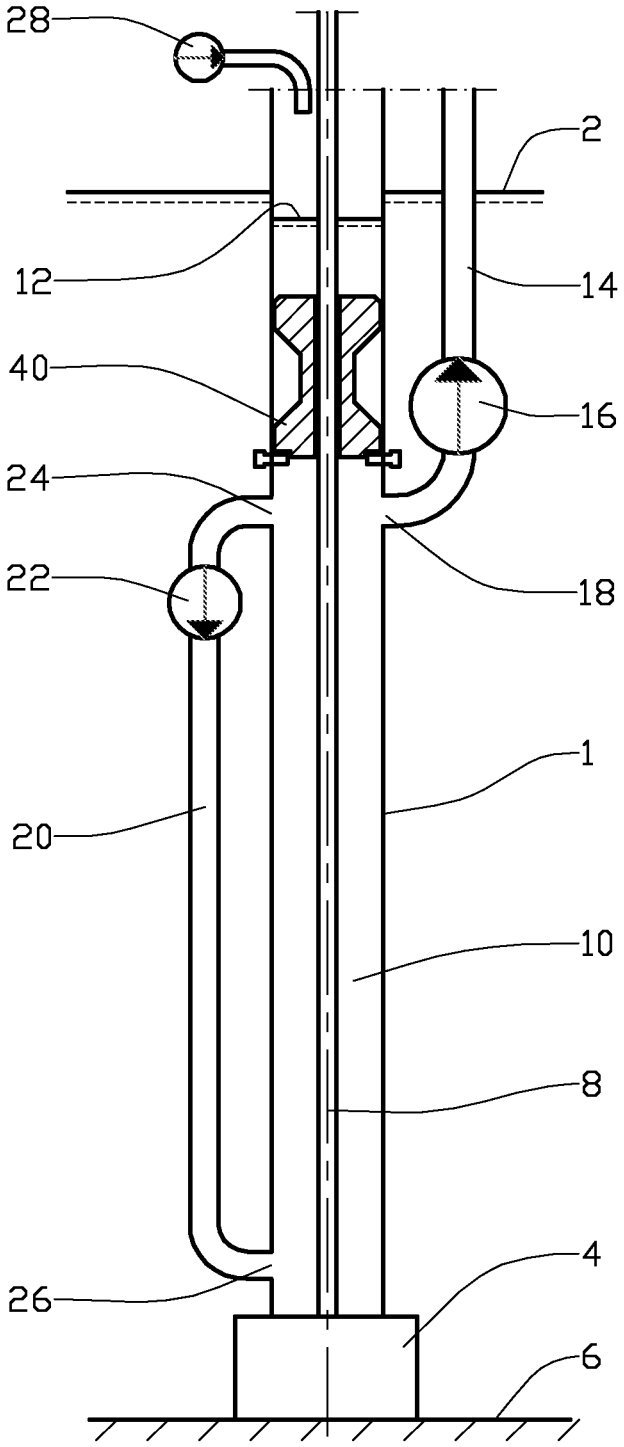
FIG. 5 shows the same as in FIG. 1, but with a riser isolation device inserted in the marine riser's annulus.

In an embodiment shown in FIG. 5, a riser isolation device 40 is positioned in the annulus 10 above the first and second connection positions 18, 24. The purpose of the riser isolation device 40 is to enable quick pressure change in the annulus 10 below the riser isolation device 40.

Figure 6:
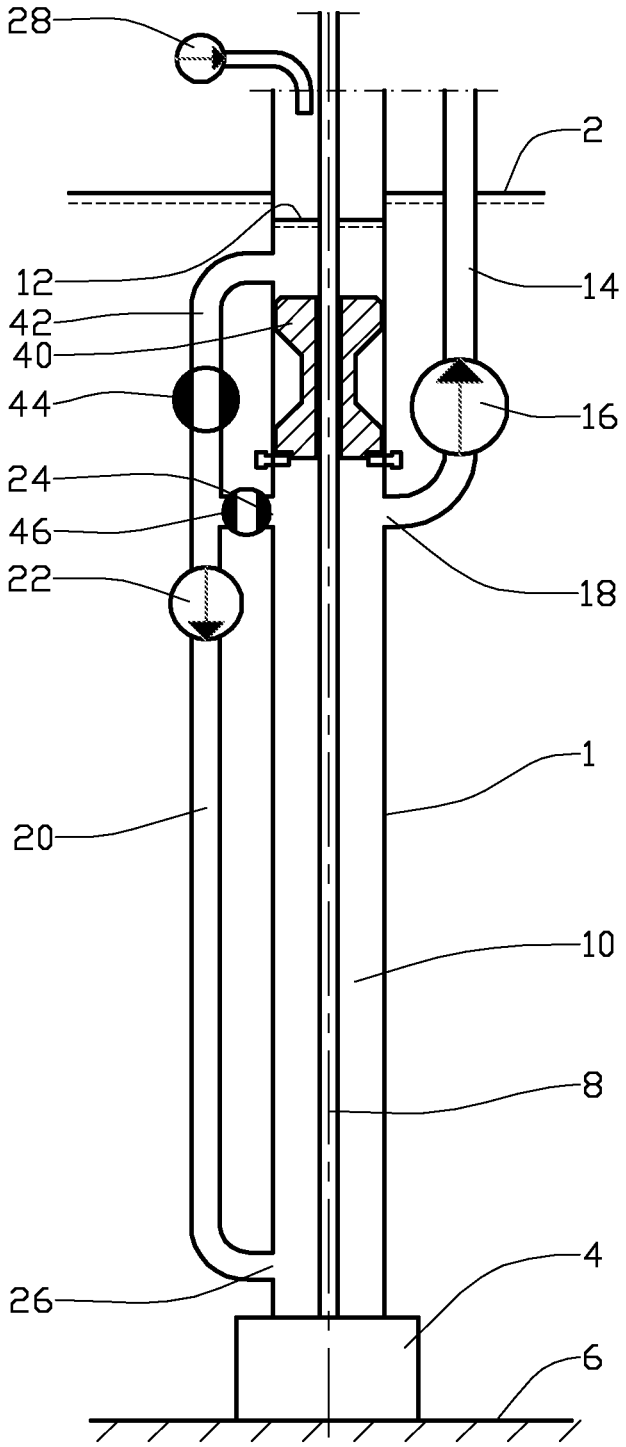
FIG. 6 shows the same as in FIG. 5, but with a riser isolation bypass line included.

In FIG. 6 a riser isolation bypass line 42 with a riser isolation bypass valve 44 is connected to the marine riser 1 above the riser isolation device 40 and the recirculation line 20 upstream the recirculation pump 22. The second connection position to the marine riser 1 is closed by a riser connection valve 46.

When the riser isolation bypass valve 44 is open and the riser connection valve 46 is closed, clean mud may be supplied by the topside pump 28 and to the marine riser 1 near the sea bed 6 through the riser isolation bypass line 42, the recirculation pump 22 and the recirculation line 20.

The invention claimed is:

1. A boost system for dual gradient drilling comprising:

a marine riser having a mud return line connected at a first connection position on the marine riser located below the lowest foreseeable mud level in the marine riser;

a mud return pump connected to the mud return line;

a recirculation line having a recirculation pump, wherein the recirculation line is connected to the marine riser at a second connection position on the marine riser located below the lowest foreseeable mud level in the marine riser, and at a third connection position on the marine riser located below the second connection position, and wherein the boost system is configured to circulate mud downwardly through the recirculation line.

2. The boost system for dual gradient drilling according to claim 1, wherein the third connection position is near a sea bed.

3. The boost system for dual gradient drilling according to claim 1, wherein the marine riser further comprises a boost line, and the boost line is closable by use of a boost line valve, and wherein the mud return line, downstream of the mud return pump, is connected to the boost line above the boost line valve.

4. The boost system for dual gradient drilling according to claim 3, wherein the recirculation line, downstream of the recirculation pump, is connected to the boost line at a position below the boost line valve.

5. The boost system for dual gradient drilling according to claim 1, further comprising a riser isolation device that is positioned within the marine riser at a location above the first connection position.

6. The boost system for dual gradient drilling according to claim 5, further comprising a riser isolation bypass line that is connected to the marine riser at a position above the riser isolation device and to the recirculation line at a position upstream of the recirculation pump.

7. The boost system for dual gradient drilling according to claim 6, wherein the riser isolation bypass line has a riser isolation bypass valve.

8. The boost system for dual gradient drilling according to claim 7, further comprising a riser connection valve that is positioned in the recirculation line between the second connection position and the recirculation pump.

9. A method for boosting return flow at dual gradient drilling with a system including a marine riser having a mud return line connected at a first connection position located below the lowest foreseeable mud level in the marine riser, and a mud return pump connected to the mud return line, the method comprising:

connecting a recirculation line having a recirculation pump to the marine riser at a second connection position on the marine riser located below the lowest foreseeable mud level in the marine riser, and at a third connection position on the marine riser located below the second connection position, and circulating mud downwardly through the recirculation line.

* * * * *